United States Patent [19]

Lee

[11] 4,109,444

[45] Aug. 29, 1978

[54] HORIZONTAL CARTONING MACHINE

[76] Inventor: Richard G. Lee, 780 Boylston St., Boston, Mass. 02109

[21] Appl. No.: 784,572

[22] Filed: Apr. 4, 1977

[51] Int. Cl.[2] ..... B65B 43/28

[52] U.S. Cl. ..... 53/186; 93/53 R

[58] Field of Search ..... 53/186; 93/53 R, 53 SD

[56] References Cited

U.S. PATENT DOCUMENTS 3,057,267 10/1962 Johnson ..... 93/53 R 3,881,298 5/1975 Griner et al. ..... 53/186 X

*Primary Examiner*—Travis S. McGehee

*Attorney, Agent, or Firm*—C. Yardley Chittick

[57] ABSTRACT

A machine for erecting a tubular carton from flat folded form to rectangular form open at both ends, partially closing one end of the carton while it is being manually or mechanically loaded at the other end, and advancing the box to a sealing machine which closes and seals the upper and lower end panels.

12 Claims, 11 Drawing Figures

HORIZONTAL CARTONING MACHINE

FIELD OF THE INVENTION

The invention relates generally to means for erecting a collapsed tubular carton to rectangular tubular form with both ends open. With the carton in this condition it may be filled with merchandise from one end. Thereafter the flaps at the carton ends are closed and sealed to create a package ready for the marketplace. While there are expensive automatic machines for achieving this result, there are many situations where limited production requires a less expensive procedure. The machine described and claimed herein falls in this latter category.

SUMMARY OF THE INVENTION

The present invention contemplates the use of a tubular type carton in which the top and bottom have major panels extending therefrom at both ends and the front and back have dust flaps extending therefrom at both ends. This type carton when erected to rectangular tubular form and loaded from one end with merchandise, is closed by first folding in the vertical dust flaps attached to the front and back and then folding and sealing together the major inner and outer panels that extend from the bottom and top.

The machine of the present invention has a magazine which is supplied with a stack of flat tubular cartons of the type described above. The machine removes these cartons one at a time from the magazine, erects it to rectangular tubular form, holding it firmly in erected condition. The machine then immediately closes the trailing dust flap at one end and covers the remaining open space at that end so that the carton can be fully loaded from the other end without danger of the merchandise passing through.

As soon as the loading operation is completed, the machine is placed in operation and immediately closes the other trailing dust flap while the carton is still held stationary. The carton is then released from its secured position and advanced horizontally in a direction at right angles to the tubular axis. As the carton advances, folding means acts on the two leading vertical dust flaps to fold them in at right angles to be in alignment with the previously folded in trailing dust flaps.

While these operations are occurring, the inner and outer major panels extending from the bottom and top of the carton respectively remain in substantially horizontal position. The carton advancing means then continues to move the carton forward to deliver it to a carton sealing machine in which the inner major panels are folded upwardly to vertical position to overlie the previously folded dust flaps. Adhesive is applied to the undersides of the outer major panels which are then folded downward to vertical position and pressed against the outer surfaces of the inner major panels, thereby to completely seal the loaded carton.

The sealing machine above referred to is already the subject of U.S. Pat. to Lee, No. 3,921,371. It will therefore be understood that the machine of the present invention concludes its functions upon the delivery of the loaded but unsealed carton to the automatic sealer at which point the four dust flaps have been turned in and the inner major panels have been turned up to vertical thereby to hold the dust flaps in their correct inturned position.

DESCRIPTION OF A PREFERRED EMBODIMENT

Referring first to FIGS. 1, 2, 3, and 4, there is illustrated the type of collapsed carton which is erected for loading and then advanced by the machine to the automatic sealing machine.

Figure 1:
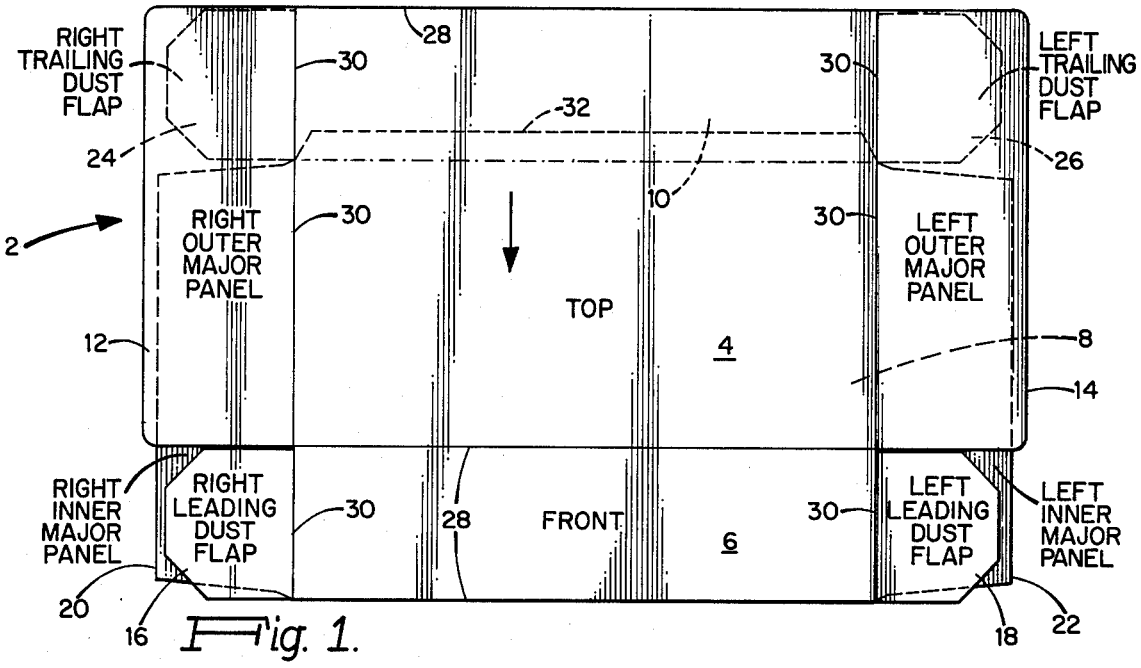
FIG. 1 is a top plan view of the collapsed tubular carton utilized in the machine.

The carton 2 in its collapsed form is shown in FIG. 1. It has a top 4, a front 6, a bottom 8, and a back 10.

Extending from the ends of the top 4 are right and left outer major panels 12 and 14. Extending from the ends of front 6 are right and left leading dust flaps 16 and 18. Extending from the ends of bottom 8 are right and left major panels 20 and 22. Extending from the ends of back 10 are right and left trailing dust flaps 24 and 26.

The four sides of the carton and the panels and flaps attached thereto are demarcated by score lines or creases 28 and 30 whereby the parts may readily be folded with respect to each other.

In order to create the continuous tubular condition of the carton, the terminal edge of bottom 8 has a narrow extension 32 which is glued or otherwise affixed to the adjacent interior edge of back 10.

Figure 5:
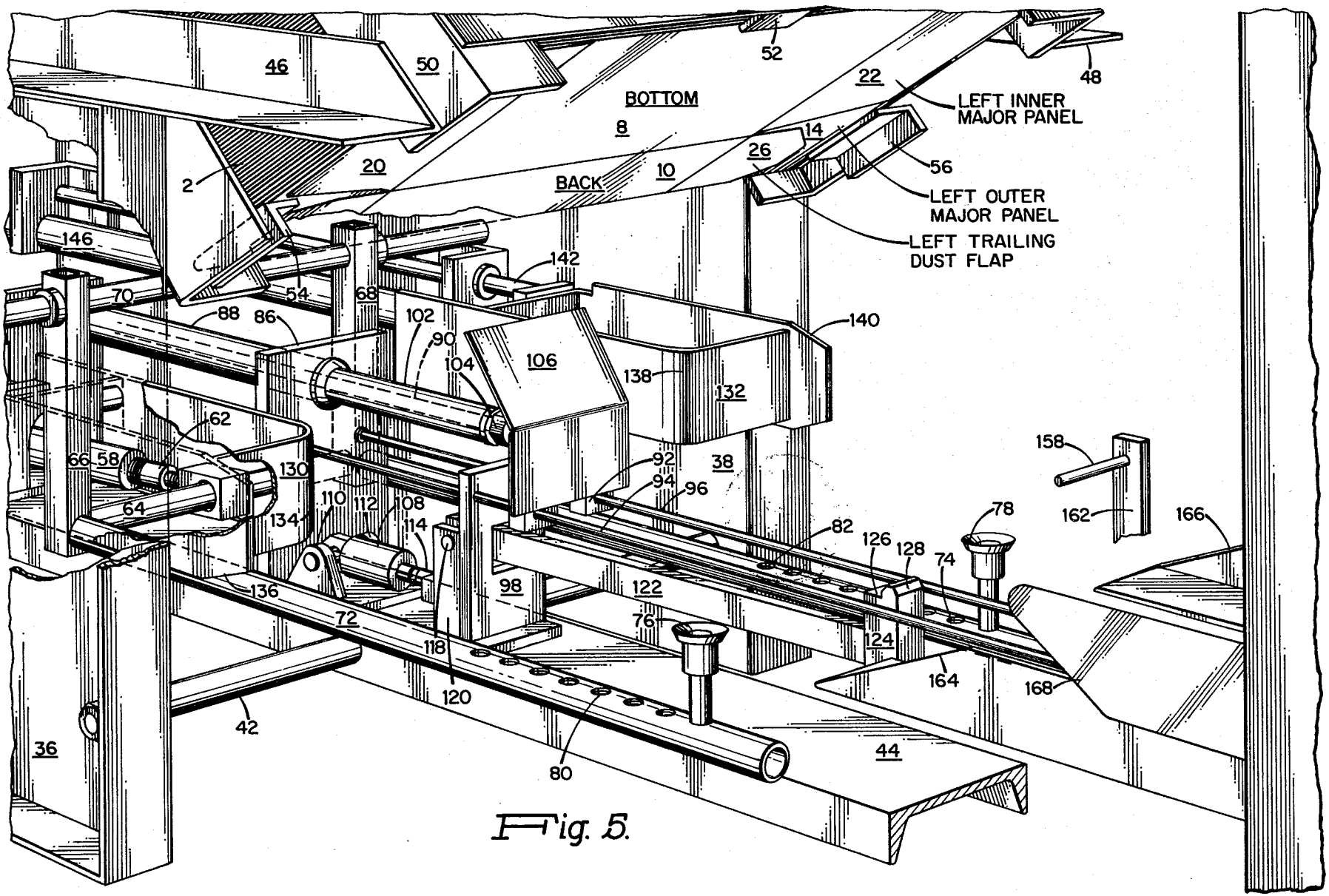
FIG. 5 is an overall perspective view of the machine with all operative elements in retracted position.
Figure 11:
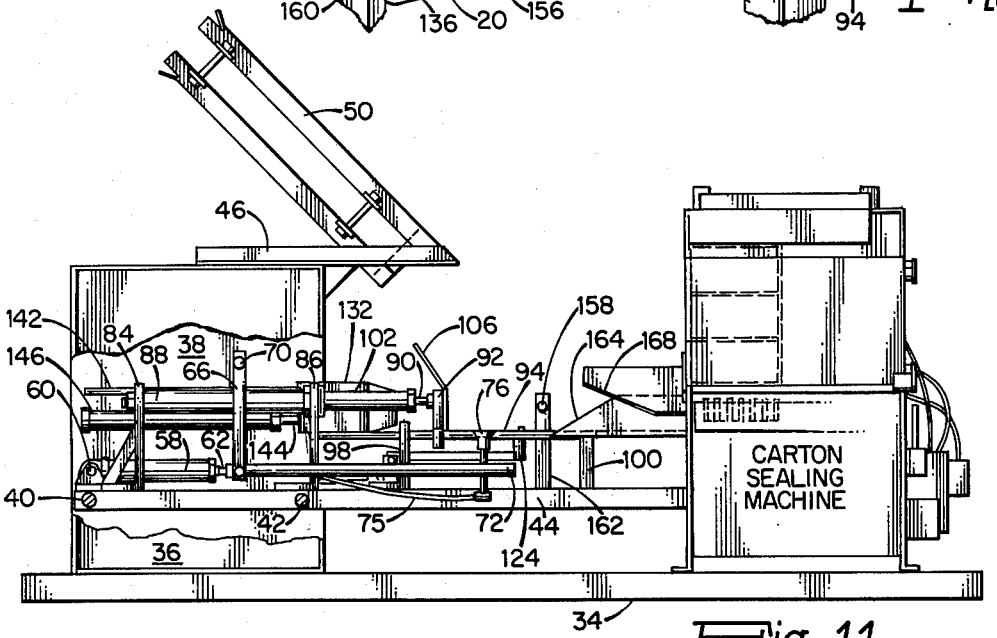
FIG. 11 is an overall side elevation to reduced scale showing the carton former on the left and the carton sealing machine on the right.

Referring now to FIGS. 5 and 11, the construction of the machine will be explained. There is a conventional base 34 on which are adjustably mounted strong supporting side walls 36 and 38. Rods 40 and 42 extend between the side walls and carry an inverted strong channel 44 on which are the operating mechanisms which will hereinafter be described.

Attached to the top of walls 36 and 38 are angle extensions 46 and 48. These extensions support a sloping magazine 50 in which are stacked a substantial quantity of collapsed cartons 2. The magazine is of any conventional form permitting the pile of cartons to descend step by step as the bottom carton is removed. The cartons are restrained from falling from the magazine by suitable lips, one being shown at 52, which engage the opposite edges of the lowermost carton. The overlap of the lip on the carton, while adequate to prevent falling of the pile from the magazine, is so small that the bottom carton can be pulled out by the suction arms as will be explained.

In addition to the lips 52, there are a pair of side lips 54 and 56 which underlie the edges of the right and left outer major panels 12 and 14. The effect of lips 54 and 56 is to compel initial opening of the bottom carton as it is withdrawn downward from the magazine.

Turning now to the channel 44, this carries an air cylinder 58 pivoted at its rear end at 60. The piston 62 of cylinder 58 is connected to cross bar 64 which hangs between a pair of arms 66 and 68 freely pivoted on cross rod 70. A pair of tubular arms 72 and 74 are rigidly affixed to arms 66 and 68 in cantilever fashion. These arms carry suction lines 75 (see FIG. 11) which terminate at the suction cups 76 and 78.

The arms contain a plurality of holes 80 and 82 whereby the location of the suction cups can be changed if necessary.

Figure 6:
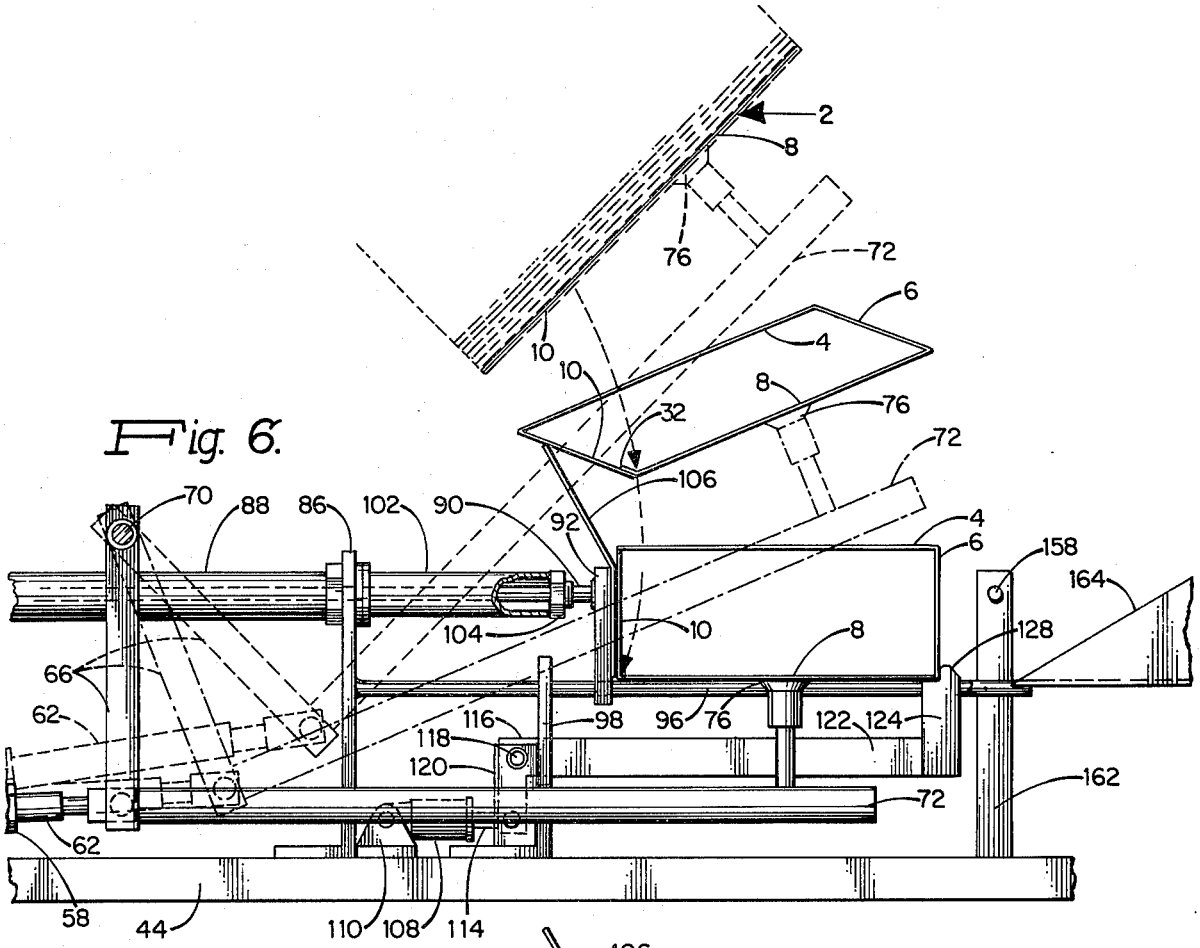
FIG. 6 is a fragmentary side elevation of the machine showing the flat carton being erected to rectangular form.

From the foregoing and by reference to FIG. 6 it can be seen that when the air cylinder 58 is actuated to extend piston 62, the arms 72 and 74 will be swung upwardly through an arc to cause the suction cups to engage the underside of bottom 8 of the lowermost carton 2 in magazine 50. When piston 62 is retracted, the suction cups 76 and 78 act to pull the bottom carton 2 from the magazine starting the carton on its course to loading position in the machine.

For the moment let us leave the descending carton 2 in midair in FIG. 6 and turn to other structure shown in FIGS. 5, 6 and 11. A pair of vertical rigid supporting plates 84 and 86 are mounted on channel 44. They carry a horizontal fixed air cylinder 88 which passes beneath cross rod 70. Cylinder 88 has a piston 90 which has on its end a pusher element 92 preferably made of white nylon. The lower part of pusher element 92 is mounted for support and sliding engagement on a pair of parallel horizontal rods 94 and 96 carried by supporting plate 86 and another rigid vertical plate 98. The remote ends of rods 94 and 96 are carried by a support 100 (see FIG. 11) adjacent the carton sealing machine.

In order to control the retraction of piston 90 and its attached pusher element 92, a length of pipe 102 surrounds piston 90. The left end of the pipe engages plate 86 and the right end will be engaged by an adjustable nut 104 on piston 90. By these means, the retracted position of pusher element 92 will be constant but subject to adjustment when needed to accommodate a different sized carton.

On the face of pusher element 92 is mounted a carton erecting plow 106. This is preferably made of a plate of stainless steel of appropriate dimensions and bent along a horizontal axis as shown in the drawings. This plow helps to erect and locate the carton in a manner that will soon be explained.

One further device is also mounted on channel 44. As best seen in FIGS. 5 and 6, there is a small air cylinder 108 pivotally mounted at one end between a pair of upstanding ears 110 and 112 which are secured to channel 44. Piston 114 of cylinder 108 is pivotally connected to a bell crank 116 pivoted at 118 on side supports 120 associated with plate 98. The bell crank has a short vertical arm and a long horizontal arm 122. On the outer end of arm 122 is a vertical latch 124 recessed to provide a small supporting surface at 126 adjacent which is an upwardly extending stop 128. As can best be seen in FIG. 5 arm 122 passes freely through plate 98 and is centered below rods 94 and 96 so that latch 124 extends upward between the rods. When piston 114 is retracted in cylinder 108, the latch 124 drops below rods 94 and 96.

The spacing between the vertical portion of plow 106 and stop 128 should be just enough to accept the width of the bottom 8 of the carton.

Two other elements must be mentioned before coming to the description of the operation of the machine in erecting the cartons. These elements are the right and left dust flap tuckers and major panels spreaders. In FIG. 5 the right hand element which for convenience will be called the right tucker spreader is indicated at 130 and the left tucker spreader at 132. Each element comprises two parts, the tucker 134 and the spreader 136 in element 130; and in element 132, the tucker is part 138 and the spreader part 140.

Figure 9:
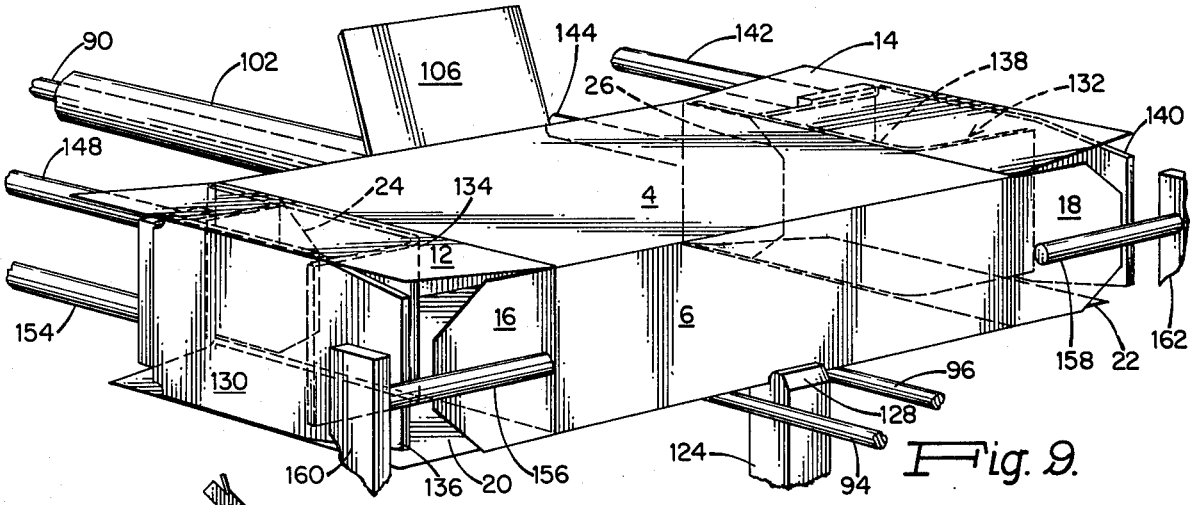
FIG. 9 shows the condition of the carton after it has been filled with merchandise. Both flap tuckers and spreader have been advanced so that both trailing dust flaps are closed and the upper and lower major panels have been separated enough to prevent interference with the leading dust flaps.

As can be seen in FIGS. 5, 9 and 11, left tucker spreader 132 is mounted on a slidable guide rod 142 and a piston 144 extending from an air cylinder 146. Guide rod 142 slides in a pair of spaced brackets mounted on wall 38. Cylinder 146 is also mounted on wall 38. When piston 144 is extended tucker spreader 132 will move from its position shown in FIGS. 5 and 11 to an extended position laterally between plow 106 and latch 124 (see FIG. 9). Such movement will, as explained in more detail hereinafter, fold in the left trailing dust flap 26 and spread the left major panels 14 and 22 and also block the left end of the carton.

Figure 7:
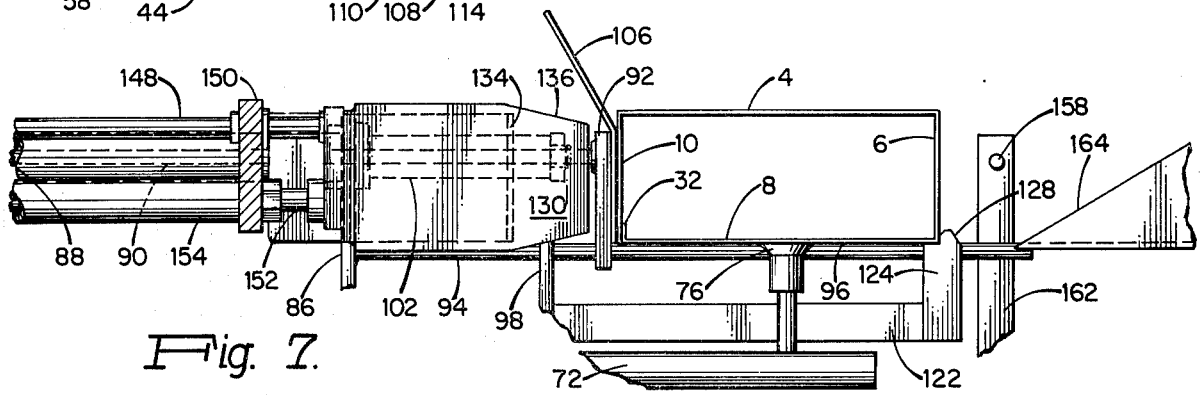
FIG. 7 is similar to parts of FIG. 6 with one of the flap tucker and spreader unit added.
Figure 8:
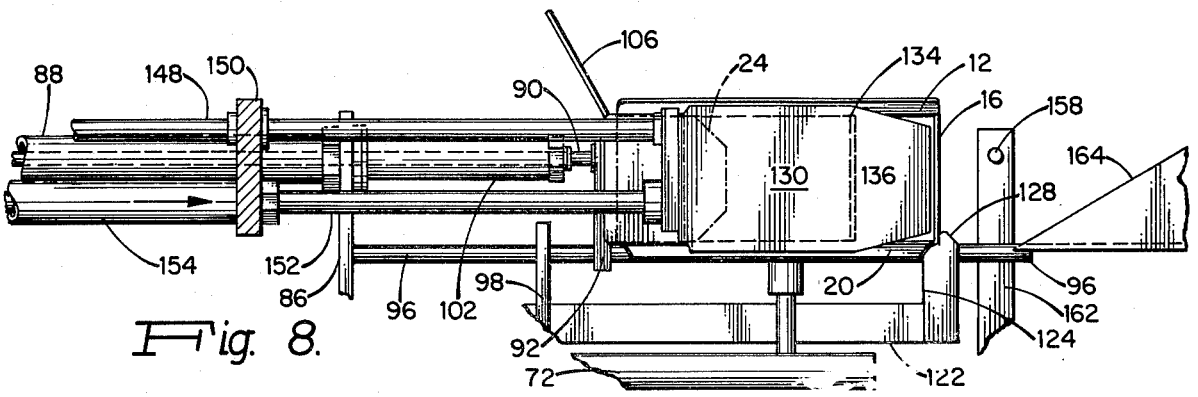
FIG. 8 shows the flap tucker and spreader unit moved forward to close the right trailing dust flap while spreading the right inner and outer major panels. This operation occurs after the carton is loaded.
Figure 10:
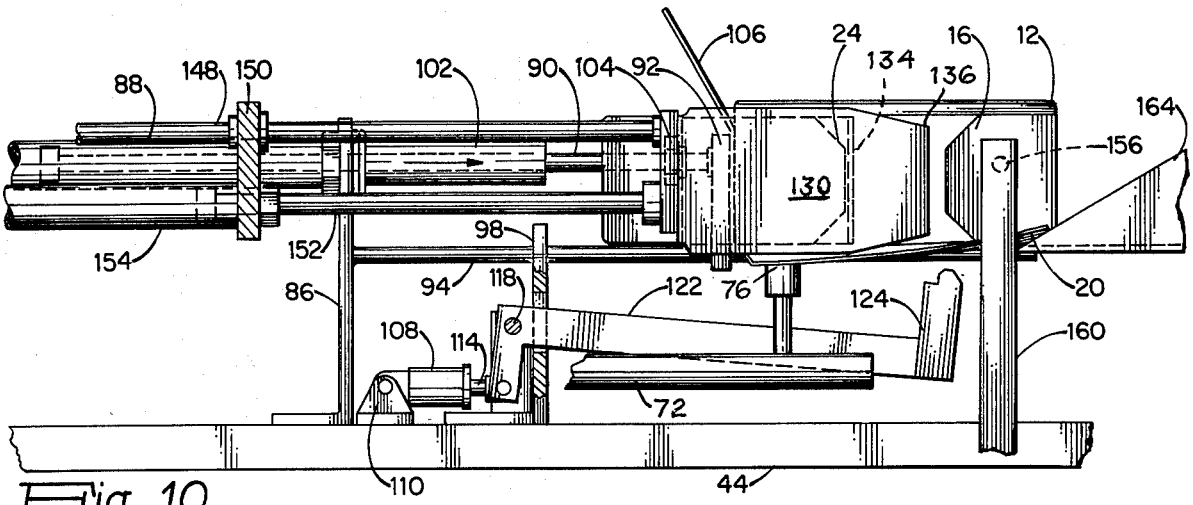
FIG. 10 shows the carton being advanced toward the sealing machine after being unlatched following loading. The leading dust flaps have been turned in and the right inner major panel is starting to be turned up by the ramp on the sealing machine.

The right tucker spreader 130 functions in the same manner as left tucker spreader 132. Tucker spreader 130 as viewed in FIGS. 7, 8, and 10 is carried by a guide rod 148 slidable in a pair of spaced brackets one of which is shown in FIGS. 7 and 8 at 150 mounted on wall 36. The function of tucker spreader 130 is similar to that of tucker spreader 132, namely, to fold in trailing dust flap 24 and to spread the right major panels 12 and 20.

OPERATION OF THE MACHINE

It has been mentioned previously that when piston 62 of cylinder 58 is extended the arms 72 and 74 will be swung upwardly through an arc to put the suction cups 76 and 78 in engagement with the bottom 8 of the lowermost carton 2 in magazine 50. A vacuum pump (not shown) supplies negative pressure to the suction cups at this time through automatically operated valves and tubing running from the pump to the tubular arms to the suction cups.

After the suction cups have firmly gripped the bottom 8, piston 62 is retracted, pulling arms 72 and 74 downward to remove the lowermost carton 2 from the magazine (see FIG. 6). The side lips 54 and 56 shown in FIG. 5 momentarily restrain the outer major panels 12 and 14 which extend from the top 4 so that the carton begins to open as it leaves the magazine. Then as shown in FIG. 6, as the arms 72 and 74 carry the carton downward, the back 10 engages the top of plow 106 moving the parts of the carton more toward rectangular form. Finally when the arms are all the way down, the carton bottom 8 will rest on rods 94 and 96. The back 10 will be vertical, resting against the vertical part of plow 106. The front bottom corner as seen in FIG. 6 will rest on surface 126 of latch 124 and the stop portion 128 will lock the carton against shifting to the right after the suction cups 76 and 78 have been released.

With the carton in the erected position shown in FIG. 6, all of the flaps 16, 18, 24, and 26 will be in the planes of their respective front and back 6 and 10. Likewise, the panels 12, 14, 20, and 22 will extend horizontally from the ends of the top 4 and bottom 8. Thus the carton is in tubular form, open from end to end. However, before the carton is loaded with merchandise, it is desirable to close one end of the carton to a sufficient extent so that the entering merchandise will be prevented from passing beyond the remote end of the carton.

Figure 2:
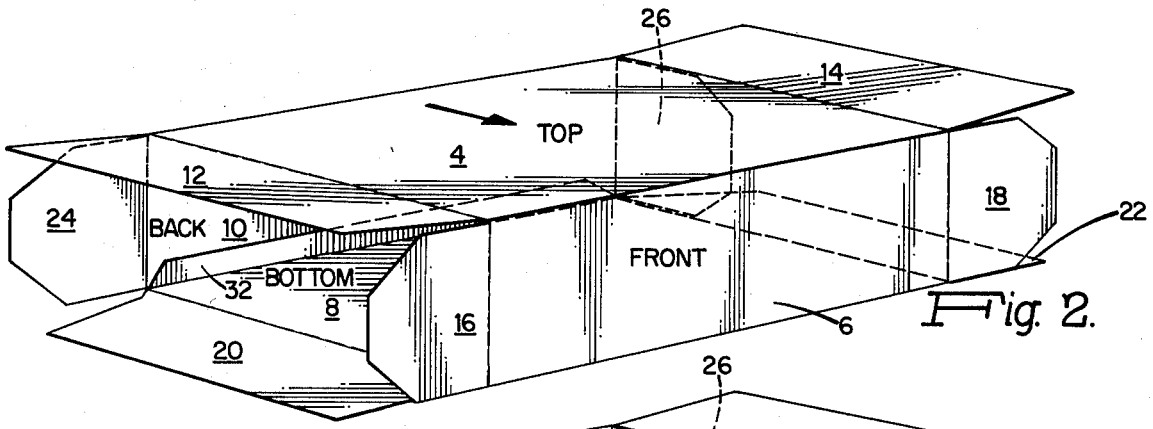
FIG. 2 is a perspective view of the carton erected to rectangular tubular form with the left trailing dust flap turned in. The carton is loaded when in this condition.
Figure 3:
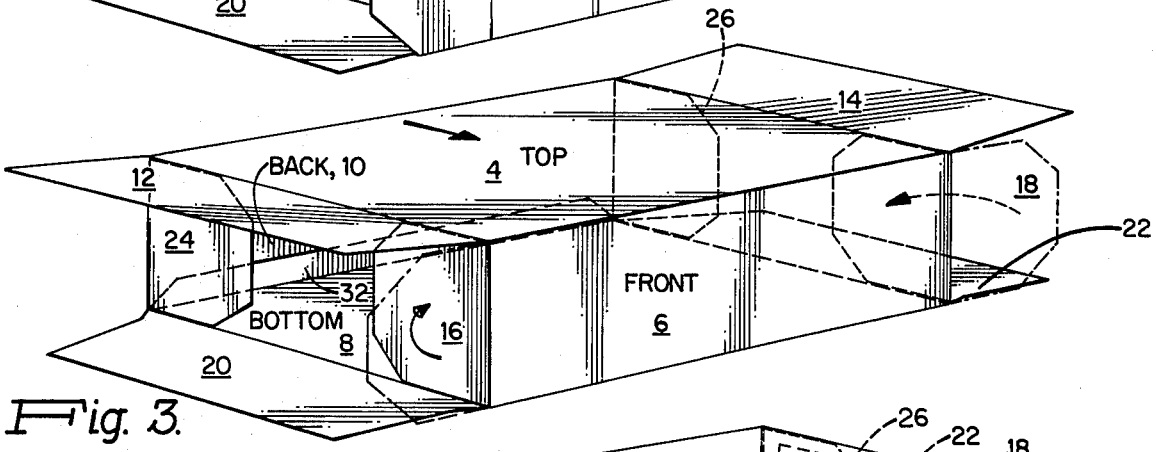
FIG. 3 is a perspective view of the carton as it is advancing from loading position to the sealing machine. All dust flaps have been turned in. The inner and outer major panels are unchanged.
Figure 4:
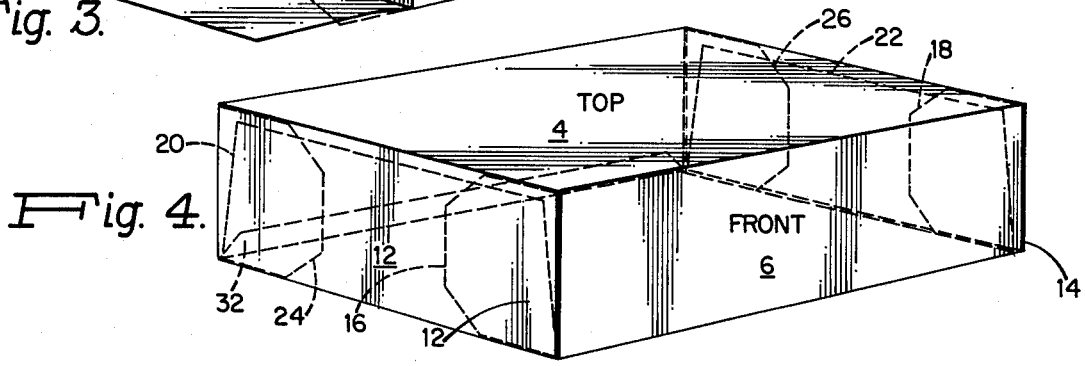
FIG. 4 is a perspective view of the carton after it has been sealed by the subsequent sealing operation.

Temporary closing of the remote end of the carton is accomplished in this manner. Referring to FIG. 9, the tucker spreader 132 is advanced by piston 144 so that the spreader portion 140 first raises panel 14 and lowers panel 22. The flap tucker portion 138 then engages trailing dust flap 26, turning it through 90° to the dotted line position shown. The initial separation of panels 14 and 22 by spreader portion 140 not only prevents any interference with the folding of trailing dust flap 26 but also prevents interference with the subsequent folding of leading dust flap 18. The tucker spreader 132 stops its forward motion at the position shown in FIG. 9 where it, in cooperation with folded flap 26, effectively closes that end of the carton. The other end of the carton is still completely open with the flaps 16 and 24 and panels 12 and 20 as shown in FIG. 2. With the carton now resting on rods 94 and 96 and secured between plow 106 and stop 128 as in FIG. 7 and the far end closed by flap 26 and the tucker spreader 132, the end of the cycle is reached and the machine is at rest.

The new cycle is now put into operation as follows. The carton is loaded from the open right end. Loading may be performed manually or automatically by machine. The operator presses the cycle start button (not shown). This causes the right tucker spreader 130 to advance from the position shown in FIGS. 5 and 7 to the position shown in FIGS. 8 and 9. This position matches the previously assumed position of tucker spreader 132. The panels 12 and 20 are spread somewhat by spreader portion 136 and the right trailing dust flap 24 is turned in by the flap tucker portion 134.

The latch 124 is then lowered and the vacuum in suction cups 76 and 78 is released to free the carton. Air cylinder 88 is actuated to extend piston 90 so that the plow 106 acting as a pusher advances the carton away from the tucker spreaders 130 and 132 toward the carton sealing machine. The carton is supported by the rods 94 and 96.

Immediately after the carton starts to move, the right and left leading dust flaps 16 and 18 will engage fixed pins 156 and 158 which are mounted on supports 160 and 162 secured to the channel 44 (see FIGS. 9, 10, and 11). The pins 156 and 158 act to turn dust flaps 16 and 18 at 90° to be in alignment with the previously turned in dust flaps 24 and 26.

The carton continues its advance past the pins to start into the sealing machine. As can be seen in FIGS. 5, 6, 7, 8, 10, and 11, there are a pair of spaced upwardly sloping ramps 164 and 166 which engage the under sides of the inner major panels 20 and 22 to turn them up to vertical position to overlie the turned in dust flaps. See FIG. 10. The stroke of the pusher piston 90 is long enough to move the carton beyond latch 124 and part way into the sealing machine. A limit switch is triggered at the end of the piston's stroke which activates air valves to cause the piston and plow 106 and the tucker spreaders 130 and 132 to return to the retracted positions shown in FIGS. 5, 6, 7, and 11. Air cylinder 108 is actuated to raise latch 124 and air cylinder 58 is again activated to drive piston 62 forward to raise arms 72 and 74 so that the suction cups 76 and 78 can grip the bottom of the next carton.

The next carton is then pulled down from the magazine and erected as shown in FIG. 6. Tucker spreader 132 is advanced to block the left end of this next carton.

This terminates the cycle and the machine comes to rest. The next cycle starts with the loading operation and continues on as explained above. As this next carton is pushed from the machine toward the carton sealing machine, it engages the preceding carton and pushes the latter into the sealing machine which then automatically performs the sealing operations as explained in the Lee U.S. Pat. No. 3,921,371, previously referred to.

As the first carton enters the sealing machine, other spaced downwardly sloping elements 168 (see FIGS. 5 and 11) engage the outer major panels 12 and 14 turning them part way down to a position at which glue is applied in the sealing machine as a first operation in the sealing sequence.

From the foregoing explanation of the machine and its operation, it will be understood that the invention resides in the means for erecting a collapsed tubular carton, blocking one end while the carton is loaded and then delivering it to a sealing machine with the ends partially closed and ready for the sealing operation to be completed.

It will also be appreciated that the machine is readily adjustable to accomodate cartons of different lengths and widths. The side walls 36 and 38 are movable toward and away from each other whereby the spacing of the tucker spreaders 130 and 132 may be adjusted to conform to the length of the carton. Likewise the horizontal retracted location of plow 106 may be changed by changing the length of pipe stop 102, thus to accurately accomodate a carton of different width between the vertical wall of plough 106 and latch 124.

The foregoing description of a preferred embodiment of the invention is to be considered as illustrative of the nature of the invention and not in any way limiting. Other modifications which will suggest themselves to person skilled in the art are intended to be covered by the appended claims.

I claim:

1. A machine for erecting a collapsed four sided tubular carton to loading condition, said carton having a top and bottom with outer and inner panels respectively extending therefrom and a front and back with leading and trailing dust flaps respectively extending therefrom, a magazine in which a quantity of collapsed cartons may be placed for removal one at a time, means for removing the lowermost carton from said magazine comprising an up and down movable member with suction means for engaging and gripping the bottom of said lowermost carton and then moving said carton downward from said magazine, a stationary element positioned in the downward path of said carton to engage said back to compel progressive opening of said carton to rectangular tubular condition as said carton is moving downward, carton supporting means for limiting the downward movement of said bottom, a latch engaging said carton front to hold said erected carton against movement in the direction of said latch, first horizontally moveable means for simultaneously spreading the outer and inner panels at one end of said carton and for closing the trailing dust flap attached to the back to partially close the opening at said one end, said first moveable means including means for blocking the remaining opening at said one end to an extent that will prevent merchandise placed in said carton through the other end from passing therethrough, second horizontally moveable means operable after said carton has been loaded through said other end for simultaneously spreading the outer and inner panels at said other end and for closing the trailing dust flap attached to said back at said other end, means for causing release of said suction means, means for causing disengagement of said latch, a pusher for moving said loaded carton horizontally along said supporting means through a distance greater than the width of said carton, means for retracting said first and second horizontally moveable means to their inoperative positions, means for engaging the leading dust flaps that extend from the ends of said front whereby said leading dust flaps will be closed as said carton is being moved by said pusher, said supporting means leading into a carton sealing machine, whereby said loaded carton when pushed into said sealing machine by the next following carton will have its outer and inner panels folded and sealed.

2. The machine set forth in claim 1, said up and down moveable member, said first horizontally moveable means, said second horizontally moveable means, said means for causing disengagement of said latch and said pusher are all operated by power means arranged to function in sequence.

3. The machine set forth in claim 2, and means for terminating the sequence of operations after said first horizontally moveable means has spread said panels and closed said dust flap at said one end.

4. The machine set forth in claim 3, and manually operable means for setting said elements in sequential operation with said second horizontally moveable means being the first operable element in said sequence.

5. The machine set forth in claim 1, said stationary element and said pusher being associated with each other.

6. The machine set forth in claim 1, said stationary element being in the form of a bent plate having its upper portion sloping upwardly and away from said carton and its lower portion being vertical, said lower portion comprising the face of said pusher.

7. The machine set forth in claim 1, said up and down moveable members being a pair of parallel spaced arms pivoted on a horizontal axis which is above said carton supporting means.

8. The machine set forth in claim 1, said magazine including lips which engage the edges of said outer panels whereby when said lowermost carton is withdrawn from said magazine, the resistance of said lips will induce initial opening of said carton.

9. A machine for erecting a collapsed four sided tubular carton to rectangular loading condition, said carton comprised of a top and bottom with panels extending therefrom and a front and back with dust flaps extending therefrom, said machine comprising a magazine for holding a quantity of collapsed cartons, means moveable up and down for gripping the bottom of the lowermost carton in said magazine and for moving said carton down to a predetermined carton loading position, means located in the downward path of travel of said carton to engage said back and progressively cause said back and front to be moved to vertical position by the time said predetermined loading position has been reached, means operable while said carton is stationary at said loading position for spreading the panels at one end of said carton and for folding in the dust flap of said back at said one end, subsequently operable means for spreading the panels at the other end of said carton and for folding in the dust flap of said back at said other end while said carton is still stationary at said loading position, means for moving said carton along a path at right angles to the tubular axis of said carton for a distance greater than the width of said carton, and means for closing the other dust flaps extending from the said front while said carton is moving, thereby placing said carton in condition to be received by a carton sealing machine in which said outer and inner panels will be folded over each other and secured together.

10. The machine set forth in claim 9, each said means for spreading the panels and folding in the dust flap comprising a single unitary element and means for moving said element in a horizontal direction parallel to the end of said carton to accomplish said spreading and folding.

11. The machine set forth in claim 10, a first part of said element having a vertical dimension greater than the vertical dimension of said front and back and having a tapered leading end portion, a second part of said element adapted to engage and turn said dust flap, said first and second parts so positioned with respect to each other that said first part will spread said inner and outer panels before said second part begins to turn said dust flap therebetween.

12. The machine set forth in claim 10, and a releasable latch for preventing movement of said carton away from said loading position while said panel spreading and dust flap folding means are in operation.

* * * * *